United States Patent [19]

Sylvester

[11] Patent Number: 4,766,945

[45] **Date of Patent: * Aug. 30, 1988**

[54] PROCESS AND APPARATUS FOR CASTING ROUNDS, SLABS, AND THE LIKE

[76] Inventor: Edmund Q. Sylvester, 22875 Canterbury La., Shaker Heights, Ohio 44122

[ * ] Notice: The portion of the term of this patent subsequent to Oct. 30, 2002 has been disclaimed.

[21] Appl. No.: 641,030

[22] Filed: Aug. 15, 1984

Related U.S. Application Data

[63] Continuation-in-part of Ser. No. 261,762, May 8, 1981, abandoned, which is a continuation-in-part of Ser. No. 106,391, Dec. 26, 1979, abandoned.

[51] Int. Cl.[4] ..... B22D 35/00

[52] U.S. Cl. ..... 164/136; 164/445; 164/DIG. 6

[58] Field of Search ..... 164/133–136, 164/DIG. 6, 465, 461, 425, 426, 445, 446, 483, 421, 422, 332, 340

[56] References Cited

U.S. PATENT DOCUMENTS 298,662 5/1884 Billings ..... 164/136

3,598,175 8/1971 Olsson ..... 164/135 X 3,653,427 4/1972 Evans ..... 164/483

FOREIGN PATENT DOCUMENTS 379120 8/1932 United Kingdom ..... 164/122

*Primary Examiner*—Kuang Y. Lin

*Attorney, Agent, or Firm*—Pearne, Gordon, Sessions, McCoy, Granger & Tilberry

[57] ABSTRACT

A process and apparatus for casting semi-finished metal products in which a molten-metal-proof plunger is disposed at the top of a cavity in a permanent mold. A thin band of metal is attached to the plunger and extends above its top. Inside the metal band on top of the plunger is insulation and on top of that is a barrier to the molten metal. A reservoir of molten metal is created and maintained in a pouring cup over the plunger, and the plunger is caused to descend in the cavity at a controlled rate so that the molten metal enters and fills the cavity above the plunger. Promptly after the plunger reaches the bottom of its stroke, it is reversed to lift the casting and pouring cup at least slightly out of the mold. The shim band, barrier, and insulation are expendable, but the plunger is used again.

18 Claims, 8 Drawing Sheets

PROCESS AND APPARATUS FOR CASTING ROUNDS, SLABS, AND THE LIKE

This application is a continuation-in-part of my application Ser. No. 261,762, filed May 8, 1981, which in turn was a continuation-in-part of my application Ser. No. 106,391, filed Dec. 26, 1979, both are abandoned.

TECHNICAL FIELD

This invention relates to a process and apparatus for casting rounds, slabs, and the like from high melting point metals and is particularly concerned with the direct casting of semi-finished steel products.

BACKGROUND ART

The conventional way to manufacture "semi-finished" steel products, such as rounds, slabs, blooms, and billets, is to pour molten steel into an ingot and then roll the ingot down into a round, slab, bloom, or billet in a rolling mill. The semi-finished products are then made into bars, tubes, sheet, strip, or the like, which are called "finished products."

It may require up to twenty-five or more passes through various rolling mills to transform an ingot into a semi-finished product. The reduction in cross-sectional area from an ingot to a semi-finished product is at least four to one. A great deal of energy, as well as expensive capital equipment, is thus required to reduce the ingot to semi-finished product forms.

A more modern technique for making slabs and other semi-finished products is the continuous casting process whereby molten steel is poured into a tundish, from there into bottomless, cooled vertical molds, and then withdrawn by rolls or other mechanisms in a continuous length. Pieces are cut off from this continuous length to give slabs, blooms, or billets as desired, in accordance with the shape of the vertical mold. Although deceptively simple in principle, this technique has, in practice, many inherent difficulties. Continuous casting equipment is bulky and requires a large amount of space for each installation. The capital investment is enormous, and the process is not suitable for low volume production.

Although slabs and billets can be cast by the continuous casting process, the casting of rounds by continuous casting has not proved satisfactory because rounds have the least surface area per unit of volume and are difficult to cool and otherwise handle in a satisfactory manner in a continuous casting process.

Another technique for making slabs, particularly stainless steel slabs, is the bottom pressure pouring method described in may U.S. Pat. No. 3,196,503. According to this technique, a ladle filled with molten steel is placed in a pressure vessel which is sealed with a lid. A pouring tube extends through the lid down to within approximately 4 to 6 inches (10 to 15 cm) from the bottom of the ladle. The top part of the pouring tube is mechanically connected to the filling end of the slab casting mold. Air pressure within the vessel causes the molten steel to rise through the pouring tube and enter the slab mold at the lower end, the mold being at a slight tilt. The equipment is expensive, and there are problems with inclusions, since the top portion of the slab to which inclusions normally rise is the first portion to become cool.

In early U.S. Pat. Nos. 298,662 and 319,779, it was proposed to make ingots in a mold with a falling bottom or blunger. As far as I know, these concepts never developed into commercial processes and never were capable of making semi-finished steel products. Ingots are generally much larger than semi-finished products and their surfaces do not have to be as smooth and free of defects.

DISCLOSURE OF INVENTION

An object of the present invention is to provide a new and useful process for the direct casting of semi-finished steel products, particularly rounds and slabs, and similar products of other high-melting-point metals.

Another object of the present invention is to provide an efficient and inexpensive process and apparatus for the direct casting of semi-finished products which have low levels of impurities and superior grain structure and surface characteristics.

In accordance with the present invention, semi-finished steel products are cast directly into a permanent mold provided with a special plunger assembly which is rapidly lowered into the mold as the mold is filled with molten metal and then is quickly forced upwardly as the molten metal solidifies to lift the casting slightly from the mold as it cools. This lifting puts the casting in compression and reduces cracking.

A reservoir of molten metal is provided over the casting cavity and is kept substantially full as the plunger descends into the mold. The reservoir also acts as a feed head of molten metal as the casting cools.

The mold has a casting cavity with a constant cross section which corresponds to that of the product being cast. The top of the plunger is surrounded with a thin resilient band of steel. A molten metal barrier of refractory material is formed in place inside of the steel band on top of the plunger. The refractory material holds the steel band against the sidewalls of the mold to make a sliding seal therewith, but does not bind up with thermal expansion because it is slightly compressible. The barrier and steel band are expendable. The plunger is reused. The plunger descends at rates of ½ to 4 inches per second (1.3 to 10 cm/sec). The molds can be reused many times and can be adapted to pour single rounds or slabs, or multiple rounds or slabs, or the like, as desired.

The present invention thus provides a process and apparatus for casting ferrous and other high melting point metals directly into rounds, slabs, and other semi-finished products in relatively inexpensive equipment with low production costs and high production rates, maximizes the yield from the molten metal being poured, minimizes the losses, and produces semi-finished products with improved surface quality and grain structure.

Using the present invention, slabs may be made without utilizing additional energy to reheat the steel or ingot such as is necessary to operate a rolling mill, thus conserving energy and saving substantial expense. The present invention is especially adaptable to the production of cast products in relatively small volumes, such as the production of stainless steel products, where continuous casting could not be employed because of the large output necessary and lack of flexibility.

The present invention provides cast products of excellent quality. The molten metal passes into a mold with minimal contact with air, so that oxidation of the metal is minimized. The quality of the surface of the product is improved because the upward force from the plunger on the casting minimizes the air gap between the casting and the mold and reduces areas of adhesion.

Splashes, buckles, wrinkles, and cold shots are eliminated because the metal does not drop any substantial distance. Inclusions rise to the top of the cast product and are easily cropped off. The flow of metal by gravity follows the natural convection patterns of the system, in contrast to the flow patterns produced in bottom pressure casting, because in the present invention the hot metal is fed into the top of the mold and the hot metal rises to the top of the mold.

The process and apparatus of this invention may be used to cast products from any of the ferrous metals including stainless steel and from other high-melting-point metals, such as nickel, copper, and titanium.

MODES FOR CARRYING OUT THE INVENTION

Round Mold—FIGS. 1–7

One embodiment of an apparatus of the present invention for casting rounds and an illustration of the process of the present invention are shown in FIGS. 1 to 6. Modifications to the invention which are preferred over this embodiment will be discussed later with reference to FIGS. 8 and 9.

Figure 1:
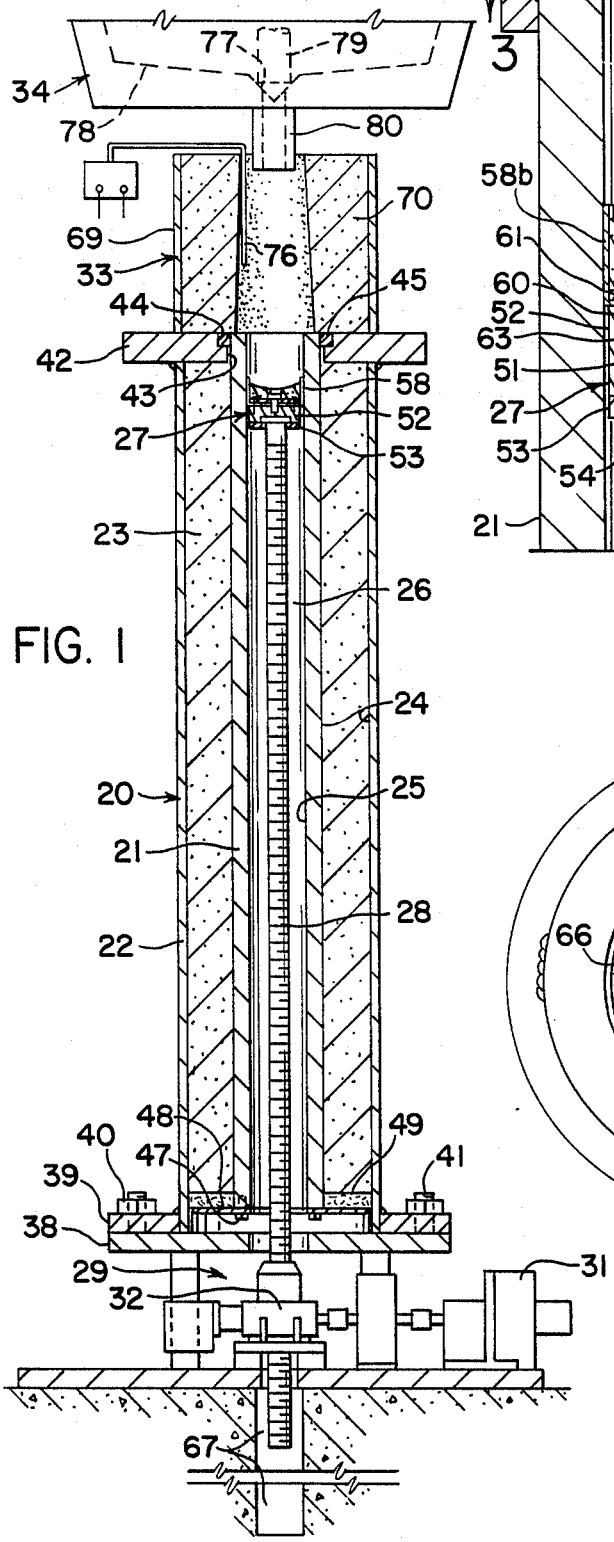
FIG. 1 is a side elevational view, in section, of a mold for casting rounds using the process and apparatus of one embodiment of the invention.

Referring to FIG. 1, there is shown a permanent mold 20 comprising an inner tubular metal sleeve 21 and a concentric, spaced-apart, outer tubular metal sleeve 22, both sleeves being circular in cross section, with sand 23 filling in the intermediate space 24. The inside wall 25 of the inner sleeve 21 defines the sides of a casting cavity 26. A plunger assembly 27 affixed to a lifting screw 28 is lowered and elevated in the casting cavity 26 by a screw jack 29 at the bottom of the apparatus. An air motor 31 drives the screw jack 29 and causes the lifting screw 28 to lower and raise the plunger assembly 27 at controlled rates as required.

Figure 4:
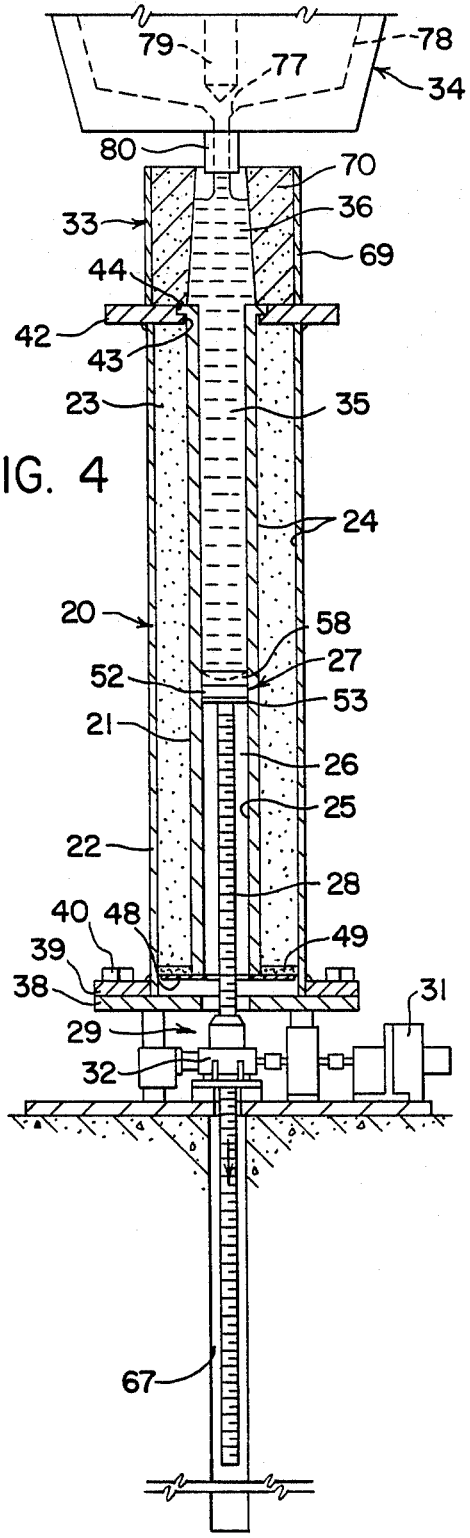
FIG. 4 is a side sectional view similar to FIG. 1, illustrating the casting process for rounds with the plunger about halfway down.
Figure 5:
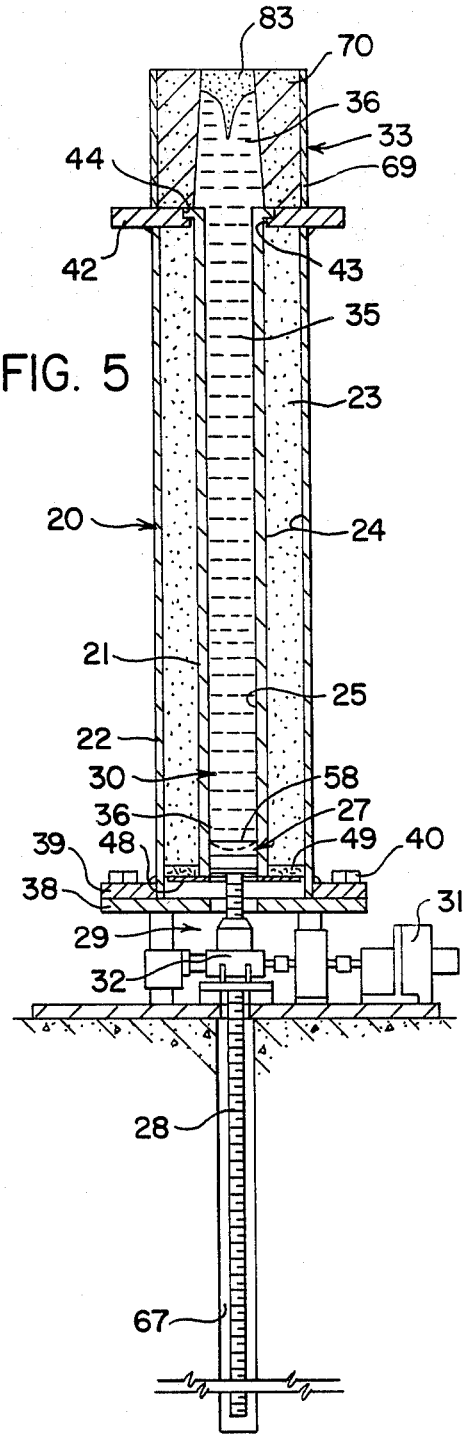
FIG. 5 is a side sectional view similar to FIG. 4 showing the plunger all the way down and the mold cavity filled with molten metal.

A pouring cup 33 is placed on top of the mold over the inner sleeve 21 and a ladle 34 is provided above the cup 33 for releasing molten metal 35 into the pouring cup, as shown in FIG. 4. At the beginning of a pour, the plunger assembly 27 is in the top of the casting cavity 26, as shown in FIG. 1. When the molten metal 35 is released into the pouring cup 33, the plunger assembly 27 is lowered at a controlled rate toward the bottom of the mold so that at the end of its descent, as shown in FIG. 5, the molten metal 35 fills the casting cavity 26. When the molten metal cools, there is formed a round or other semi-finished product with a solidified feed head 37 (FIG. 6) which is cut off.

Figure 2:
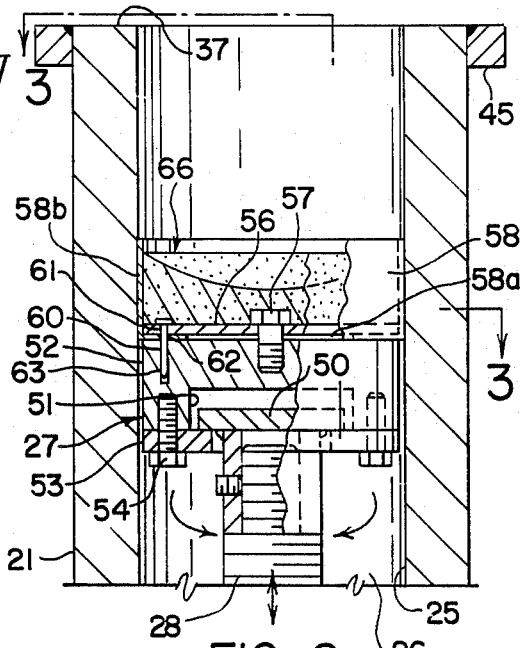
FIG. 2 is an enlarged, side sectional view of the plunger, shim band, and $CO_2$ sand molten metal barrier of FIG. 1.

Referring now in more detail to the mold 20, the outer sleeve 22 rests on a circular base plate 38 inside an annular collar 39 to which the outer sleeve is welded. The collar 39 in turn is secured by nuts 40 and tie-down studs 41 to the base plate 38, so that it can be disassembled if desired. At the top of the mold is an annular top plate 42 to which the top of the outer sleeve 22 is welded. The top plate 42 is provided with a center circular opening 43 with a diameter slightly larger than the outer diameter of the inner sleeve 21 and an upper circular countersunk groove or channel 44 into which fits an annular ring 45 (FIG. 2). The top exterior of the inner sleeve 21 is welded to the inside of the ring 45 so that the combination can be placed in the opening 43 and suspended from the top plate 42 by engagement of the ring 45 in the channel 44. The bottom of the inner sleeve 21 is not restrained and can expand downwardly without buckling or jamming as it absorbs heat from molten metal.

Secured by bolts 47 to the bottom of the inner sleeve 21 and inside the outer sleeve 22 is a round plate 48. The round plate 48 has a layer of asbestos packing or steel wool 49 between it and the sand 23 which fills the space 24 between the outside of the inner sleeve 21 and the inside of the outer sleeve 22. There is clearance between the outer circumference of the round plate 48 and the inside surface of the outer sleeve 22. The asbestos packing 49 prevents the sand 23 from running out and interfering with the necessary downward expansion of the inner sleeve 21.

The surface of the inside wall 25 of the inner sleeve 21 is preferably honed or otherwise made smooth and regular. The inner sleeve 21 should be at least about 1¼ inches (3.2 cm) thick and is substantially thicker than the outer sleeve 22 since it must maintain its strength and integrity upon direct exposure to molten metal. At the same time, the inner sleeve 21 should be as thin as possible to avoid thermal gradient and hanger crack problems.

As noted, the space 24 between the inner sleeve 21 and outer sleeve 22 is filled with sand 23, which is packed into that space to support and strengthen the inner sleeve. The space 24 may also be filled with other filler materials, such as steel shot or grit, and the like.

Preferably, the filler is of varying size and is not a good conductor of heat.

Figure 3:
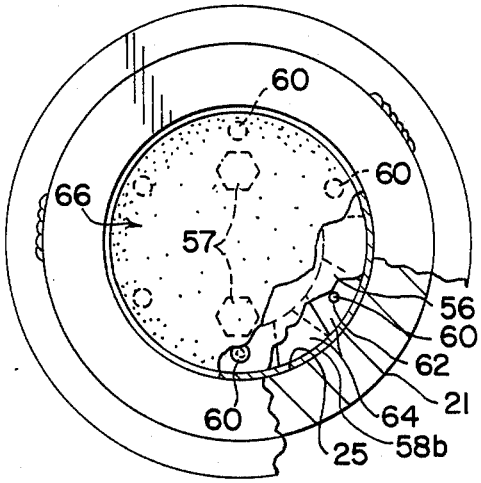
FIG. 3 is a top plan view, partially in section, of the plunger, shim band, $CO_2$ sand barrier, and top of the mold, taken along line 3—3 of FIG. 2.

The plunder assembly 27 is shown in greater detail in FIGS. 2 and 3 and comprises a heavy steel swivel plate 50 which is attached to the top of the lifting screw 28 and is held in a recess 51 in a heavy steel cylindrical piston or plunger 52 by a ring 53 which is secured to the bottom of the piston by bolts 54. Above the plunger 52 is a circular retaining plate 56 which is bolted to the top of the plunger with bolts 57. A shim band 58 of steel about 0.015 inch (0.38 mm) thick such as is used for shims extends circumferentially around and axially above the top of the plunger 52.

This shim band 58 is attached to the plunger 52 by means of nails 60 which extend through holes 61 in the retaining plate 56, through holes 62 drilled into the shim band, and through holes 63 in the plunger. The lower portion **58*a* of the shim band is provided with a multiplicity of slits 64 (FIG. 7) about 1 inch (2.5 cm) deep and about ½ inch (1.3 cm) apart, and the lower portion is then annealed and bent at a 90° angle to the other or upper portion 58*b* of the shim band. The shim band 58 is disposed about the circumference of the retaining plate 56 and the plate is placed on top of the plunger 52 and bolted to the plunger with bolts 57 which are tightened up at least finger-tight. This causes the holes 61 in the plate 56 to line up with the holes 63 in the plunger 52. The nails 60 provide a positive means of holding or retaining the shim band 58 on the plunger 52** as the piston descends.

The shim band 58 is positioned against the wall 25 of the inner sleeve 21 and smoothed out against it before the holes 62 are drilled. The ends 73 and 74 (FIG. 7) are slightly overlapped, about ½ inch. The bolts 57 may be tightened up further if desired once the shim band 58 is so positioned. The overlapped ends allow the shim band to expand but not bind up in the mold.

The shim band 58 may be made of steel or other relatively resilient and strong metal which can withstand the high temperatures involved in this process. The thickness may range from as little as 0.005 inch (0.13 mm) up to about 0.035 inch (0.89 mm).

Silica sand mixed with a suitable core binder is then rammed into the space above the retaining plate 56 up to within about ⅛ inch (0.32 cm) of the top of the shim band 58 and cured to form a refractory barrier 66 for the plunger 52. The shape of the barrier 66 is preferably concave as shown in FIG. 2 so that the sand is higher on the sides and lower in the middle. A rammer having a diameter which is slightly smaller than the diameter of the inner sleeve 21 and a curved forward surface readily forms this shape. The top of the shim band 58 should extend at least about ⅛ inch (0.32 cm) above the top of the barrier 66 so that the sand cannot rub off against the inside wall 25 of the inner sleeve and cause dirt and/or cracks in the casting. The sand is cured by a carbon dioxide gas or a "no bake" system or otherwise, as is well known in foundries to make cores with good continued hot strength, to form a hard, solid, slightly compressible, refractory molded-in-place barrier 66 on the plunger 52. After curing, any loose sand should be blown or brushed off the barrier 66 and the inside wall 25 of the inner sleeve. The refractory, rammed-in-place, cured core sand barrier or cover 66 for the plunger 52 has to be made up in place as described for each cast. It holds the shim band 58 against the sidewalls 25 of the mold. The plunger 52 and the retaining plate 56 can be used over again. A new shim band 58 is preferably used for each cast.

There should be openings and clearances downwardly from the refractory barrier 66 so that any gases generated by contact between the barrier and the molten metal can escape downwardly and are not forced upwardly through the molten metal. The barrier 66 is porous so that any gases blow downwardly through it, through nail holes 61 in plate 56, through the clearance between plate 56 and plunger 52, and through the clearance between the inside wall 25 and plunger 52 into the inside of the mold.

The plunger 52, barrier 66, and shim band 58 formed as described above make a sliding, molten-metal-proof seal with the inside wall 25 of the inner sleeve 21 and have the same cross-sectional shape as the casting cavity 26 and product being cast. The term "molten-metal-proof seal" signifies that molten metal does not flow past the plunger or, if a small amount does flow past the plunger, it is not enough to jam the plunger or in any way damage the means for lowering and raising the plunger.

The lifting screw 28 and screw jack 29 may be a ball jack or screw jack such as shown in U.S. Pat. No. 3,323,777, and constitute the means for lowering and raising the plunger assembly 27. Preferably, there are ball bearings in the worm gear in the housing 32 to provide what is called a ball bearing screw jack. Also, there should be swivel means somewhere in the connection between the lifting screw 28 and the plunger assembly 27 so that there is no tendency to rotate the plunger assembly when the screw jack is activated to lower or raise the plunger. In the floor supporting the mold there must be a bore hole 67 with a depth at least equal to the travel of the plunger assembly 27 in order to accommodate the lifting screw 28 as it lowers the plunger assembly downwardly into the mold.

Mounted at the top of the mold 20 over the molding cavity 26 is the pouring cup 33 (FIG. 1) which comprises a cylindrical metal can 69 or section of steel pipe which is filled with shaped, bonded refractory core sand 70. The sand 70 is rammed in place around a frustoconical plug of suitable shape with the small end up and then cured. The sand 70 may have a silicate binder system which is cured with a carbon dioxide, a "no bake" system, or a system in which a resinous binder is set by a catalyst and is cured with heat. Sharp silica sand such as used in foundries for cores may be used for this purpose.

The pouring cup 33 directs molten metal into the casting cavity 26 and forms a reservoir 36 of molten metal above the plunger assembly 27 before and as the plunger descends and as the casting cools. The pouring cup 33 may be designed with the smallest cross-sectional area at the top and with the area increasing as the cup extends downwardly, as shown in FIGS. 1–7 or with the greatest cross-sectional area at the top. The pouring cup 33 should be kept substantially full of molten metal throughout the pour and should be substantially full before the plunger assembly 27 starts to descend. A probe or sensor 76 (FIG. 1) may be draped over the top of the pouring cup 33 so that when molten metal reaches the tip of the sensor, it shorts out a circuit and causes the screw jack air motor 31 to start the plunger assembly 27 down.

At the beginning of a pour, the plunger assembly 27 should be as close to the top of the mold as possible, and preferably within less than 3 inches (7.6 cm) of the top of the mold 20, and as close to the bottom of the pouring cup 33 as is possible so as to minimize the distance through which the molten metal falls.

The ladle 34 has a lining 78 of suitable refractory material and is provided with a bottom opening 77 closed by a removable stopper 79. The ladle 34 can have a slide gate in place of the stopper 79 or the steel can be lip poured. When the stopper 79 is lifted, the molten metal flows out through a spout 80 beneath the bottom opening 77, as shown in FIG. 4.

The process of the present invention is illustrated in FIGS. 1, 4, 5, and 6. In FIG. 1, the ladle 34 is above the top of the mold with the stopper 79 closed to retain molten metal in the ladle 34. The plunger assembly 27 is at its starting position at the top of the casting cavity 26.

In FIG. 4, the stopper 79 has been lifted and molten metal, such as steel or stainless steel or nickel, is being fed into the pouring cup 33 from the ladle 34 as the plunger assembly 27 descends. Molten metal 35 fills the casting cavity 26 above the plunger assembly 27 and molten metal substantially fills the pouring cup 33 to provide the reservoir 36 of molten metal over the casting cavity. The ladle operator should pour the molten metal into the pouring cup 33 at approximately the same rate that it runs into the casting cavity 26 and thereby maintain a good supply of molten metal in the pouring cup so that the plunger does not outrun the supply of molten metal as it descends.

The plunger 28 is lowered at a rate of about ½ to 4 inches per second (1.3 cm/sec to 10.2 cm/sec) with a preferred rate for rounds of about 1½ to 2½ inches per second (3.8 to 6.35 cm/sec), depending upon the size of the pouring cup 33 and the size of the product and other factors which will be apparent to those skilled in the art. A 10-foot (3-meter)-long round, six inches (15.6 cm) in diameter, can be cast in about 50 to 80 seconds.

Long rounds, up to say 40 feet (12 meters) long, may be cast in accordance with this process, in which event it may be desirable to vary the rate of descent of the plunger assembly in the course of the pour.

Figure 6:
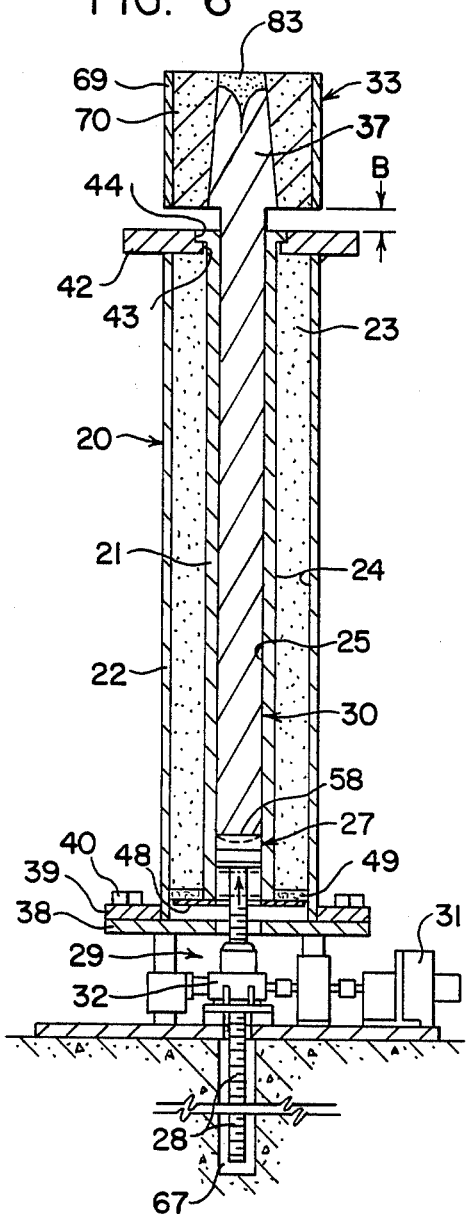
FIG. 6 is a side sectional view similar to FIGS. 4 and 5 showing the cast round and pouring cup lifted slightly from the mold as the cast round cools.
Figure 7:
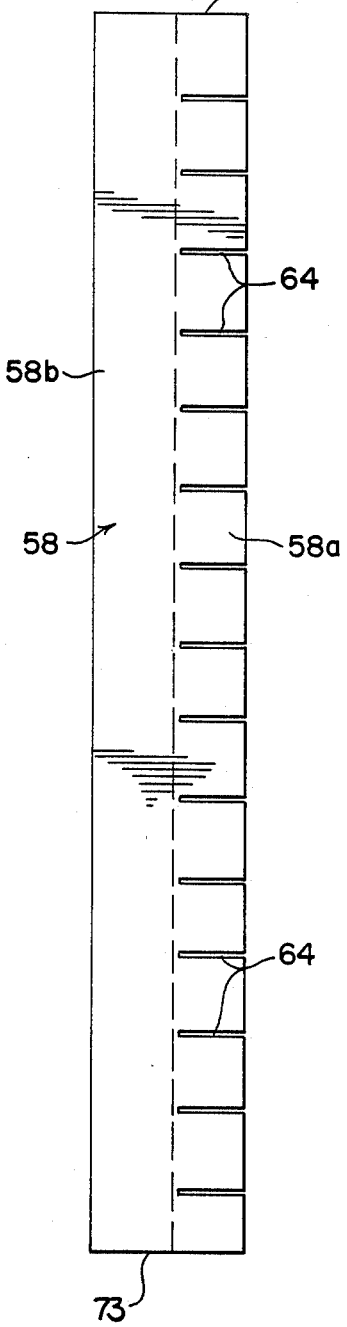
FIG. 7 is a plan view of the shim band of FIGS. 1–6.

In FIG. 5, the plunger assembly 27 has completed its descent, forming a round casting 30. Anti-piping or insulating material 83, such as Ferrux material made by Foseco, Inc., is spread over the top of the metal in the pouring cup 33 to keep the metal in the reservoir 36 in molten condition and to permit it to feed downwardly into the casting under atmospheric pressure as the casting cools. If desired or found necessary, an exothermic material may also be used for this purpose. Promptly after the plunger assembly 27 has completed its descent, and after the casting has cooled enough to have vertical strength, the plunger's motion is reversed and it is raised. At this point, the inside of the casting may be molten, but the walls of the casting will have solidified and be thick enough to give it vertical strength so that it is not distorted when lifted by the plunger. In FIG. 6, the plunger assembly 27 has been raised to lift the casting 30 and pouring cup 33 out of the mold 20 a short distance B which is at least about ¾ inch (1.9 cm) and can be up to 3 or 4 inches (7.6 to 10.2 cm). The plunger assembly 27 is held in this position as the casting 30 cools and shrinks, and may be raised a second or third time to accommodate the shrinkage and prevent the bottom of the pouring cup 33 from coming to rest upon the top of the mold 20. It is important that a lifting force be applied to the bottom of the casting as it cools so as to maintain contact between the solidifying casting 30 and the inside wall 25 of the mold, break any areas of adhesion between the mold wall and casting surface, and delay the formation of an air gap. The hydrostatic pressure forces of the molten metal are thus taken up by the plunger assembly and the development of horizontal and vertical hanger cracks prevented. The longer the period of time that the sides of the solidifying casting can be held against the mold wall, the cooler the casting will become, the finer its grain structure, and the better its surface. All of this time, the reservoir of molten metal 36 in the feed head 37 feeds molten metal into the casting as it solidifies and shrinks.

The upwardly directed lifting force is accomplished by reversing the plunger assembly 27 for a short period until the pouring cup 33 begins to lift off the top of the mold 20. The plunger assembly 27 is then stopped, the casting 30 is allowed to shrink, and the pouring cup 33 may resettle onto the top of the mold 20. The plunger assembly 27 is again moved upwardly and the upwardly directed force is reapplied until the pouring cup 33 again begins to lift from the top of the mold 20. This procedure may be repeated two or three or more times as needed until the shrinkage of the casting 30 is completed. The lifting or reversal step may be commenced immediately after the plunger assembly 27 reaches the bottom of the mold, and preferably is begun within about a minute after the plunger reaches the bottom of its cycle.

For the final step in the process, the solidified feed head 37 formed in the pouring cup 33 is removed from the round casting 30 by burning off or otherwise cropping at the top of the casting, and the finished round is lifted from the mold by appropriate lifting means such as tongs carried by a crane and while simultaneously being pushed from the bottom by the plunger assembly 27. At this point, the cast product has substantially solidified and has cooled and contracted away from the inside wall 25 of the mold so that it can be stripped from the mold.

For steel molds, it is desirable to form and maintain an oxide coating on the inside wall 25 which acts as an insulative layer between the molten metal 35 and the inner sleeve 21. The oxide forms rapidly in the temperature range of from about 1700° F. to 2000° F. (about 930° C. to 1090° C.) and for this reason, a sand with relatively good insulative properties, such as silica sand 23, is used in the space 24 between the inner sleeve 21 and outer sleeve 22 so that the inner sleeve reaches the temperatures to form the oxide. Within obvious design limits, the inner sleeve 21 is also preferably made to be relatively thin from wall to wall so as to reach the temperatures at which the insulative oxide is formed quickly when exposed to the molten metal. An added advantage of a thin inner sleeve is that a hotter sleeve expands more and thereby relieves pressures on the casting. For an eight-inch (20.3-cm) round, the inner sleeve 21 should be about 1½ inch (3.8 cm) thick.

In order to permit the inner sleeve 21 to reach the temperatures at which the insulative oxide layer is formed on its inside surface, the weight of the inner sleeve should preferably be about 1¼ to about 1½ times that of the product being cast therein.

If desired, air can be blown through the silica sand 23 to cool it down should it reach temperatures about 2000° F. and begin to lose its strength and structural integrity. If it becomes desirable to increase the heat conductivity of the material in the space 24 between the inner and outer sleeves, steel grit or shot or similar material can be mixed in with the sand.

The means for lowering and raising the plunger and for providing its controlled vertical movement may be any suitable hydraulic, mechanical, pneumatic, or electrical means other than the screw jack arrangement shown.

The plunger has to be pulled downwardly throughout most, if not all, of its descent. One can only speculate as to what happens inside of the mold. It is believed that there is a molten nugget of metal maintained over the top of the refractory barrier 66 and that a shell of solidified metal forms perhaps an inch or so above the top of the shim band as the plunger descends. The refractory barrier 66 should also insulate the molten metal from the plunger so that heat is not drawn from the molten metal.

The shim band 58 performs several important functions. It permits the plunger assembly to make a molten-metal-proof seal with the inside wall 25 of the mold, and also permits this assembly to slide along the mold wall so that it can be pulled downwardly with a minimum of frictional resistance. The shim band 58 also separates the refractory material of the barrier from the inside wall 25 of the mold, so that sand or other matter does not rub off on the wall as the plunger descends. If the inside mold wall becomes contaminated, it may result in unacceptable surface quality in the casting, circumferential cracks, and other defects.

Finally, there must be some means in the refractory barrier/shim band arrangement to accommodate the thermal forces generated by the expansion of the refractory barrier and shim band after they have been exposed to the molten metal as the plunger assembly moves down the mold. Thermal expansion of the refractory barrier and shim band could otherwise cause the plunger assembly to be bound up in the mold. The shim band 58 may provide compensation for its thermal expansion and avoid any bind-up from being expanded and pressed against the sidewall 25 of the mold by having its overlapped ends overlap a slightly smaller amount. The cured-in-place sand of the refractory barrier provides compensation for thermal expansion by compressing slightly at the sides and edges to relieve the thermal forces. It is difficult to determine from examination of a plunger assembly after a pour exactly what has happened. I believe, however, that a combination of the compensations or adjustments described above occurs.

Slab Mold—FIGS. 8–13

Figure 8:
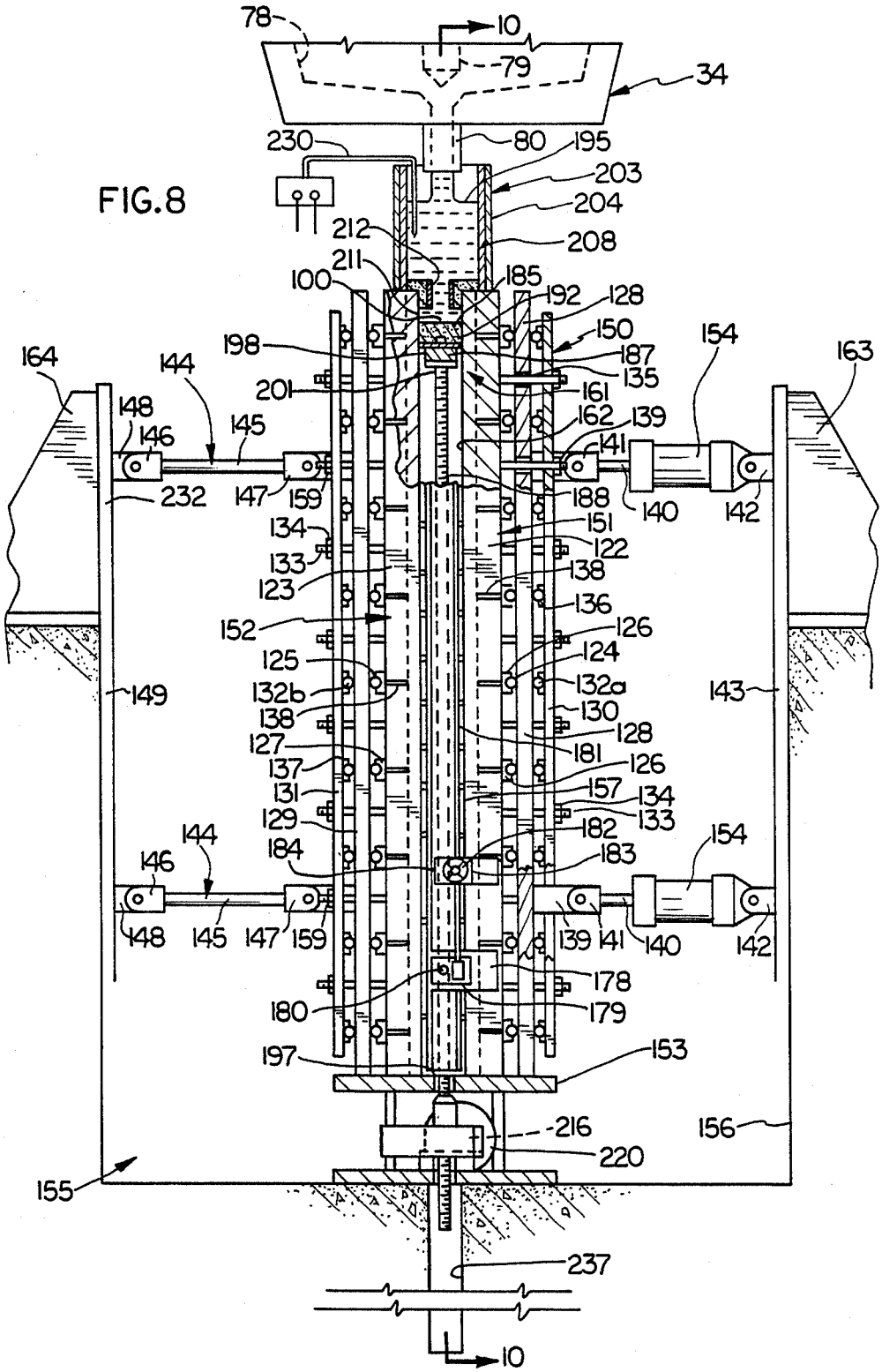
FIG. 8 is an end elevational view, with portions in section, of a mold showing another embodiment of this invention for casting a slab.

FIGS. 8–13 show another embodiment of the invention for the production of slabs. Referring to FIG. 8, a mold 150 comprises two identical strongback-reinforced side blocks or side sections 151 and 152 which are supported in a parallel, vertical, upright position on a stool or base plate 153 and positively maintained in that position by a multiplicity of hydraulic rams 154 which press against the side blocks. The assembly is preferably placed in a concrete pit 155 and the hydraulic cylinder and piston mechanisms or rams 154 are affixed to the sidewalls 156 of that pit.

Figure 9:
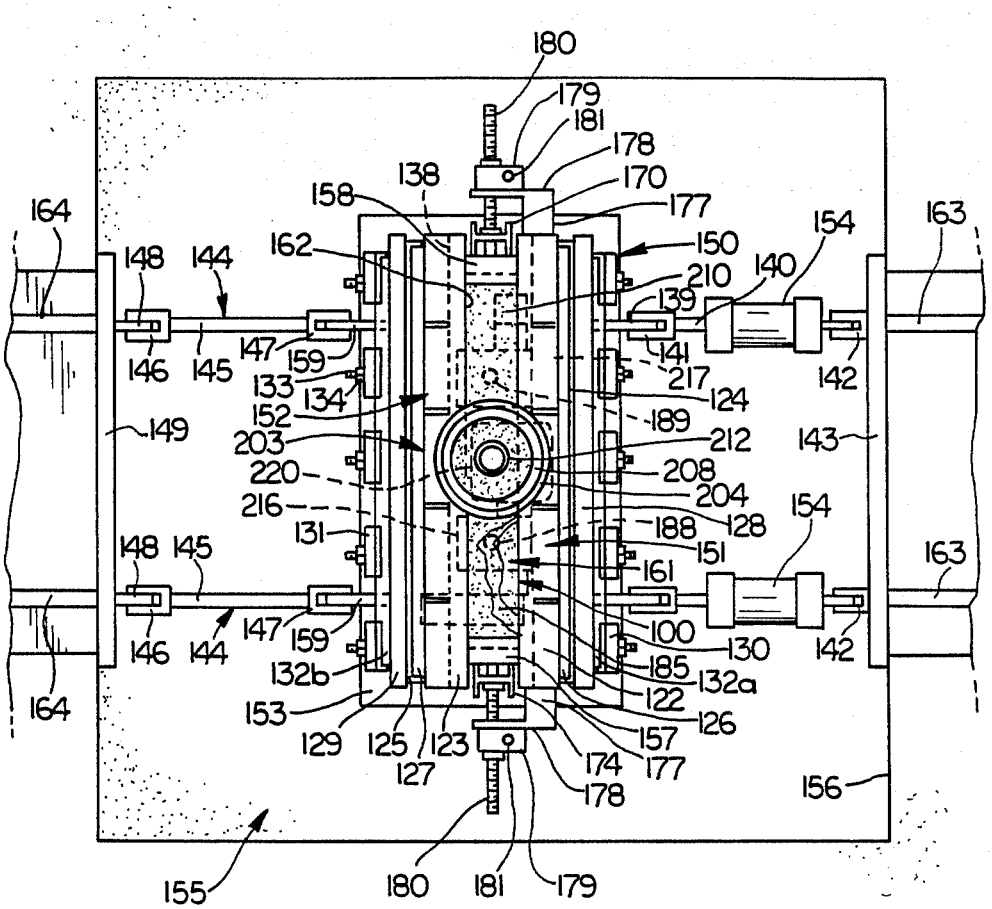
FIG. 9 is a top plan view of the slab mold of FIG. 8.

As shown in FIG. 9, the side blocks 151 and 152 are separated and spaced apart by two pairs of identical vertical strongback-reinforced end blocks 157 and 158 to form a casting cavity 162 having a plunger assembly 161. Referring to FIG. 8, the side blocks 151 and 152 comprise inner mold sides 122 and 123, about 8 inches (20 cm) thick, horizontal inner roller bars 124 and 125 which fit in channel bars 126 and 127, outer plates 128 and 129, and backing plates 130 and 131. Horizontal outer roller bars **132*a* and 132*b* are positioned opposite the inner roller bars 124 and 125. Nelson studs or machine bolts 133 are welded to the backsides of the inner mold sides 122 and 123 and then secured to the backing plates 130 and 131 with nuts 134. The Nelson studs 133 extend through slots 135 in the outer plate 128 of side block 151 (see broken-away cross section, FIG. 8) which are large enough to accommodate movement as the mold heats up and contracts. The same arrangement is made for the other side block 152. Metal strips 136 and 137 are welded to the inside surface of backing plates 130 and 131 to provide channels for the outer roller bars 132*a* and 132*b*. For side block 151, the inner and outer roller bars 124 and 132*a* are thus positioned and clamped on opposite sides of the outer plate 128 and the side block 152** is similarly constructed.

The inner mold sides 122 and 123 are provided with slits 138 about 3/16 inch (5 mm) wide and 3 inches (76 mm) deep, which run vertically and horizontally on 6-inch (15-cm) squares. The function of the slit and back-up arrangement is to permit expansion and contraction of the side blocks 151 and 152 without buckling or warping. The inner and outer roller bars 124, 125, **132*a*, and 132*b* accommodate the movement caused by expansion and contraction of the metal and the Nelson studs and nuts 133 and 134, which clamp the outer plates 128 and 129 to the backing plates 130 and 131, prevent buckling. The slits 138** permit the inner surface of the mold side to expand with the heat from the molten metal without placing the outer surface in compression.

The hydraulic rams 154 have ram rods 139 which are attached to piston rods 140 of the rams 154 through clevises 141 (FIG. 9). The ends of the ram rods 139 extend through enlarged holes in the backing plate 130 to clamp against the outer surface of the outer plate 128. The clevis arrangement accommodates small movements of the outer plate 128. The rams 154 are attached by other clevises 142 to a plate 143 mounted against the sidewall 156 of the concrete pit 155.

Opposite the hydraulic rams on the other side of the concrete pit 155 are stiff arms 144 which comprise a central rod 145 with clevises at each end 146 and 147. The outer clevises 146 are pivoted to lugs 148 (FIG. 9) welded to plate 149 mounted on the other side of the concrete pit 155. The inner clevises 147 are pivoted to ram rods 159 which extend through enlarged holes in the backing plate 131 against the outside of the outer plate 129.

Other suitable strongback-reinforced side blocks are disclosed in U.S. Pat. No. 3,948,311.

Figure 11:
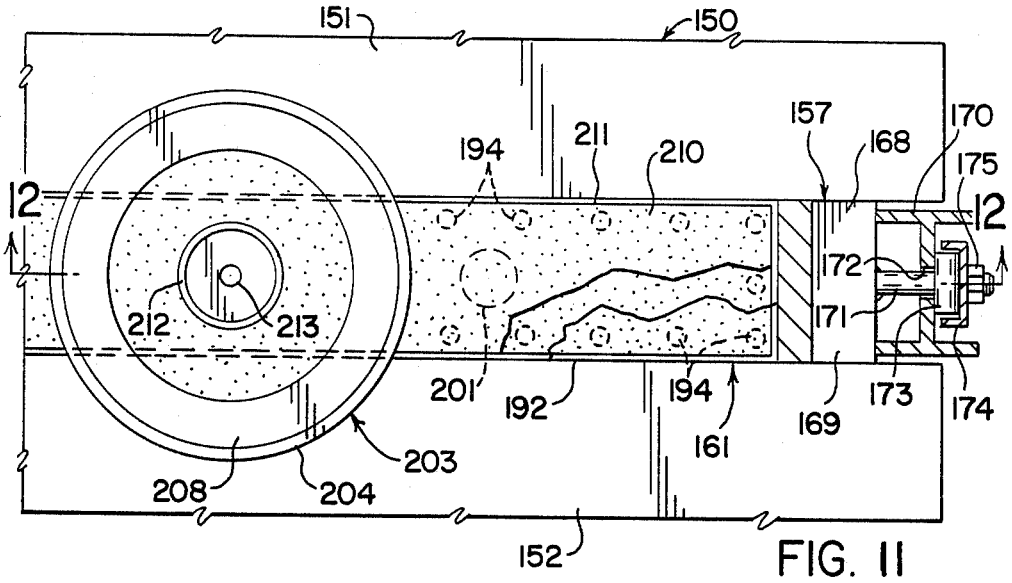
FIG. 11 is an enlarged top plan view of a portion of the pouring cup, barrier, and plunger for the slab mold of FIGS. 8–10.
Figure 12:
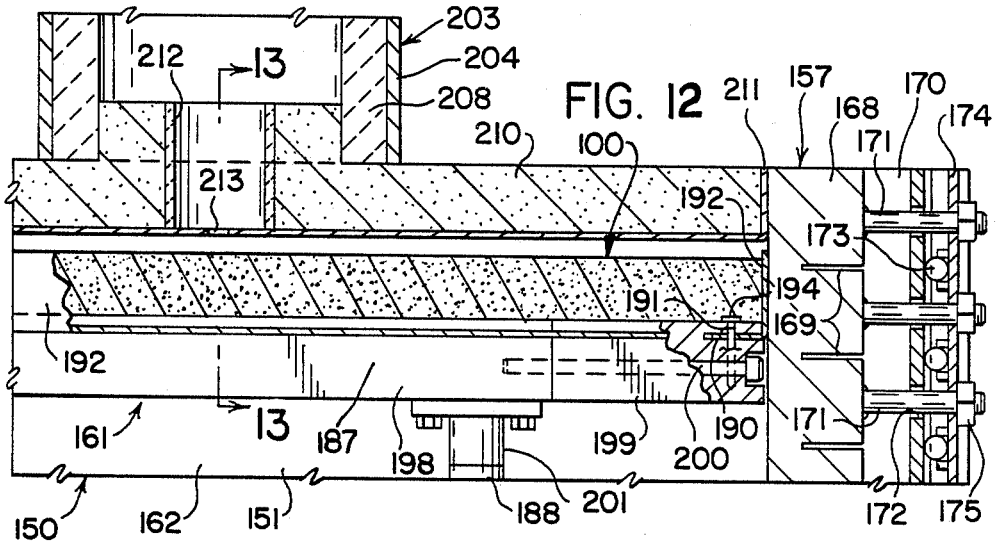
FIG. 12 is an enlarged side elevational view of a portion of the pouring cup, barrier, shim band, and plunger for the slab mold of FIGS. 8–10, taken along line 12—12 of FIG. 11.

Each of the end blocks 157 and 158 is identical and will be described with reference to end block 157. As best shown in FIGS. 11 and 12, the end block 157 is made of a narrow steel plate 168 about 4 inches (10 cm) thick with a plurality of regularly spaced, horizontal slots 169 in the outer surface thereof. An "I" beam strongback 170 is bolted onto the outer or back surface of the plate 168 with a series of Nelson studs 171 which are welded to the plate and extend through holes 172 in the "I" beam. A plurality of cylindrical rollers 173 are disposed horizontally in a U-shaped, elongated channel member 174 above and below each stud 171 to permit any necessary movement and adjustment when the molten metal contacts the hot face of the plate 168 and causes it to expand. The slots 169 accommodate any such expansion which the "I" beam strongback 170 resists. Each Nelson stud 171 has a nut 175 which clamps the channel member 174 against the rollers 173. There is generous clearance in the holes 172 in the "I" beam strongback through which the Nelson studs 171 extend in order to avoid any binding. Each end block is assembled by horizontally placing the plate 168 and the "I" beam strongback 170, distributing the rollers 173, placing the channel member 174 over the rollers, and bolting the unit together by placing the nuts 175 on the ends of the studs 171. If desired, the rollers 173 can be held on axis pins or brackets in the channel member 174.

Figure 10:
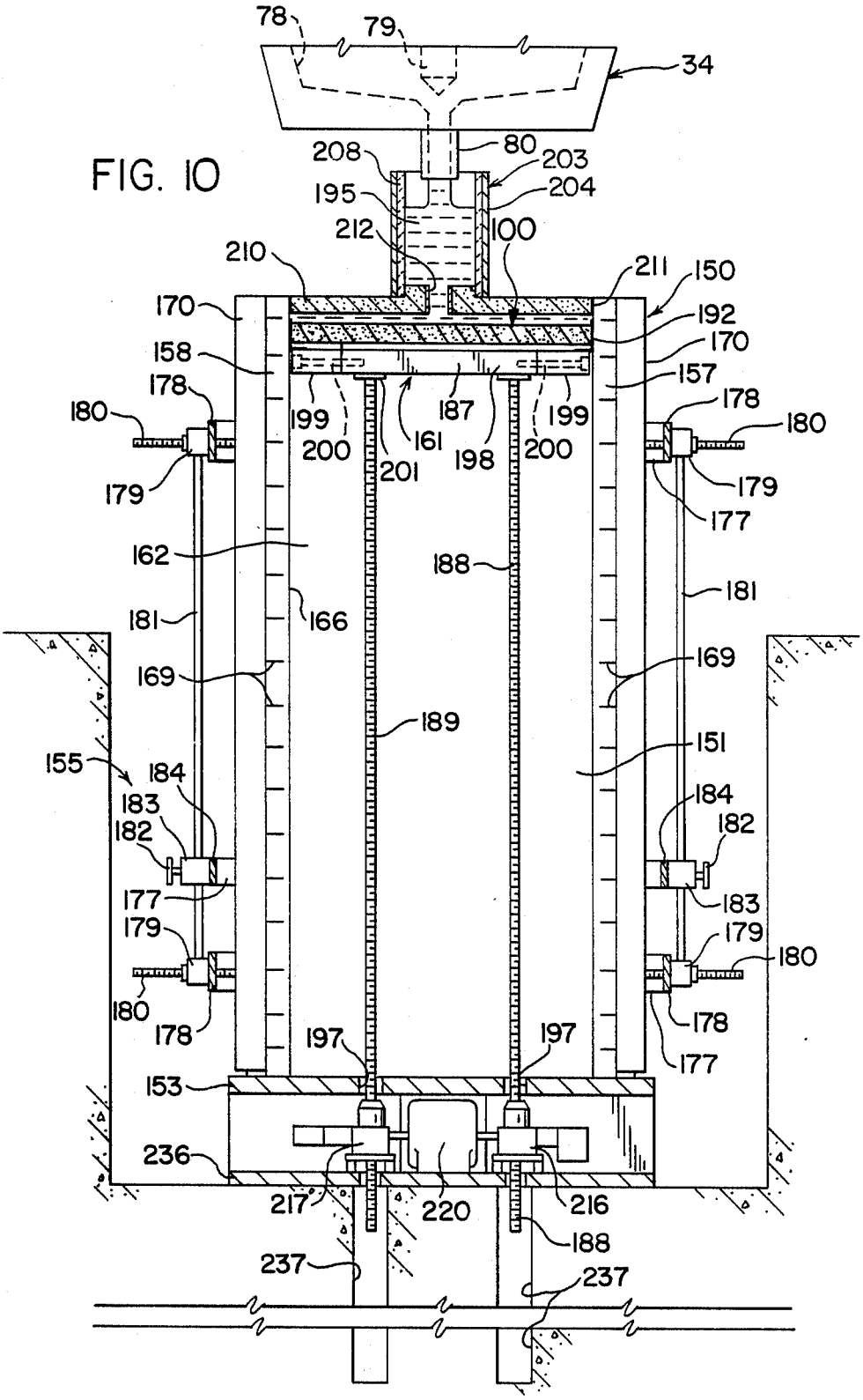
FIG. 10 is a side sectional view of the slab mold taken along line 10—10 of FIG. 8.

The end blocks 157 and 158 are attached to the edge of the side block 152 so as to be adjustable in and out and to provide slabs of varying widths. Referring to FIGS. 9 and 10, three brackets 177 are welded to each end of the side block 152. The upper and lower brackets 177 are identical, and a horizontally extending plate 178 is in turn welded to each of these brackets. A housing 179 is mounted on each end of the upper and lower brackets 177 adjacent to the end blocks 157 and 158. At least two positioning screws 180 are attached to each end block. Each positioning screw 180 passes through one of the housings 179 in which there is a worm gear driven by a worm gear drive shaft 181. One of the drive shafts 181 drives the worm gears for both positioning screws 180 attached to the end block 157. A handwheel 182 operates a second worm gear in another housing 183 (FIGS. 8 and 10) to rotate the worm gear drive shaft 181 and cause both positioning screws 180 to move in and out. There is a handwheel for each end block. The handwheel 182 extends from housing 183 which is mounted on a plate 184, which is welded to the end block 157. Obviously, other means of positioning and adjusting the end blocks may be employed.

Figure 13:
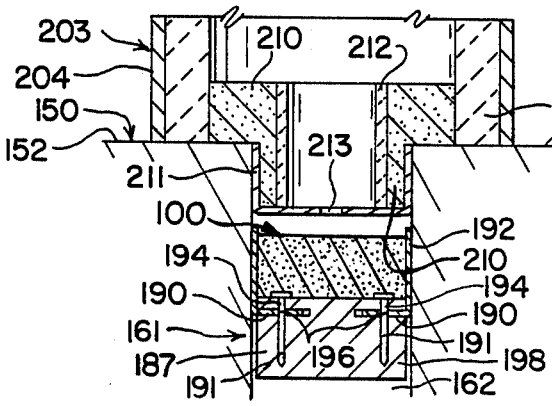
FIG. 13 is an end elevational view of a portion of the pouring cup, barrier, shim band, and plunger for the slab mold of FIGS. 8–10, taken along line 13—13 of FIG. 12.

With reference to FIG. 10, the plunger assembly 161 for the slab mold 150 comprises a plunger 187 affixed to and supported by two lifting screws 188 and 189. The plunger 187 corresponds to the plunger 52 of the plunger assembly of FIG. 2. With reference to FIGS. 12 and 13, a shim band 192 is L-shaped in cross section and the lower leg is disposed in a peripheral, horizontal slot 190 in the plunger 187. The shim band 192 is similar to the round shim band 58 except that it may be thicker. Holes 191 in the plunger 187 receive nails 194 which also go through holes 196 drilled into the shim band 192 after the shim band has been suitably positioned against the inside walls of the mold 150. A layer of silica sand is rammed in place over the top of the plunger 187 inside of the shim band 192. It is then cured to form a refractory barrier 100 similar to barrier 66 of FIGS. 1-7.

In order to facilitate the manufacture of slabs of different widths, the plunger 187 is formed of a center section 198 and two end sections 199, as shown in FIG. 12. The size of the plunger 187 thus can be modified by removing one or both of the end sections 199 from the center section 198. As shown in FIG. 12, each of the end sections 199 is bolted with a horizontal bolt 200 to the center section 198. Round threaded couplings 201 are bolted to the ends of the bottom of the center section 198 and attached to the top of the lifting screws 188 and 189 to affix the plunger 187 to the lifting screws. The plunger 187 may be lowered and raised by a pair of screw jacks 216 and 217 connected to the lifting screws 188 and 189 and powered by a motor 220, as shown in FIG. 10.

The arrangements to cover the top of the mold and provide an integrated pouring cup 203 are shown in FIGS. 11-13. The pouring cup 203 comprises a can 204 inside of which is a relatively thick ceramic sleeve 208. The top of the casting cavity 162 above the plunger assembly is covered with a layer 210 of core sand which is packed into a thin metal trough 211 and is then cured. A ceramic sleeve 212 is placed on the metal trough 211 prior to formation of the sand layer 210 and is then surrounded with packed sand which is provided with a binder as previously described. A hole 213, of perhaps 1 inch (2.5 cm) in diameter, is made in the metal trough 211 so that when molten metal is placed in the sleeve 212, it will quickly burn out the hole 213 and flow unrestrictedly into the space above the plunger assembly 161. Before a pour, the plunger assembly 161 should be lowered away from direct contact with the bottom of the metal trough 211 which supports the core sand layer 210 a distance of at least ½ inch (1.3 cm). This provides space between the refractory core sand on the plunger 187 and the metal trough 211 through which molten metal can flow. Obviously, other arrangements to cover the top of the casting cavity and provide a reservoir of molten metal over the cavity and access to the cavity may be employed. For instance, metal plates may be supported by the side blocks 151 and 152 and a pouring cup placed between them.

The flux may be added to the system by placing a small sheet of cardboard over the hole 213 and then placing the flux inside the ceramic sleeve 212 where it will be supported by the metal trough 211. The molten metal thus pours through and mixes with the flux.

A probe or sensor 230 (FIG. 8) is placed in the pouring cup 203 and set so that when the pouring cup is substantially full of molten metal, it will automatically start the plunger downward.

The pit 155 in which the mold 150 is set is provided with a vertical plate 143 (FIG. 8) to which the rams 154 are affixed and the stiff arms 144 are attached to a similar plate 149 on the other side of the pit. The plates 143 and 149 extend above the ground level approximately one-third of the distance of the depth of the pit. The above-ground portions of the plate are buttressed by vertical backing plates 163 and 164. The hydraulic fluid supply and controls for the rams 154 are placed out of and away from the pit. The rams 154 press the assembly of side blocks 151 and 152 and end blocks 157 and 158 tightly together to form the casting cavity 162 for each pour and are released when the upward lifting force from the plunger assembly 161 is discontinued. As shown in FIG. 10, the screw jacks 216 and 217 are mounted on a plate 236 in the bottom of the pit. Holes 197 are provided in the base plate 153 for the lifting screws 188 and 189. A pipelined bore hole 237 is provided in the ground immediately beneath the lifting screw of each screw jack to accommodate its respective lifting screw as the plunger is lowered.

Slabs are cast in the apparatus of FIGS. 8-13 in accordance with the same process as that used for the rounds. The plunger assembly 161 is raised to the top of the mold 150 and formed with the shim band 192 and $CO_2$ sand 193, as previously described, so as to have a sliding molten-metal-proof seal with the inside walls of the mold, which must be smooth and define the casting cavity 162. The pouring cup 203 is placed and/or formed over the casting cavity 162. Molten metal is poured from the ladle 34 into the pouring cup 203, and when the pouring cup is substantially full to provide a reservoir of molten metal 195, the plunger assembly 161 is caused to descend at a rate of about ½ to 4 inches per second (1.3 to 10 cm/sec) until it reaches the bottom portion of the casting cavity 162, at which point it stops descending and almost immediately begins to push upward with at least enough force to break adhesions and prevent hanger cracks. The slab is pushed upwardly, and the pouring cup 203 may be lifted off the top of the mold 150. As the casting shrinks, the upwardly directed lifting force is re-applied as before to keep the cooling metal in compression. Then, after perhaps 10 to 15 minutes, the cast slab cools and can be stripped or ejected from the mold by releasing the pressure in the hydraulic rams 154 and raising the plunger assembly 161. The solidified feed head formed in the pouring cup 203 may be burned off while the casting is in the mold, or the casting may be lifted from the mold and cut off at a separate location.

Figure 14:
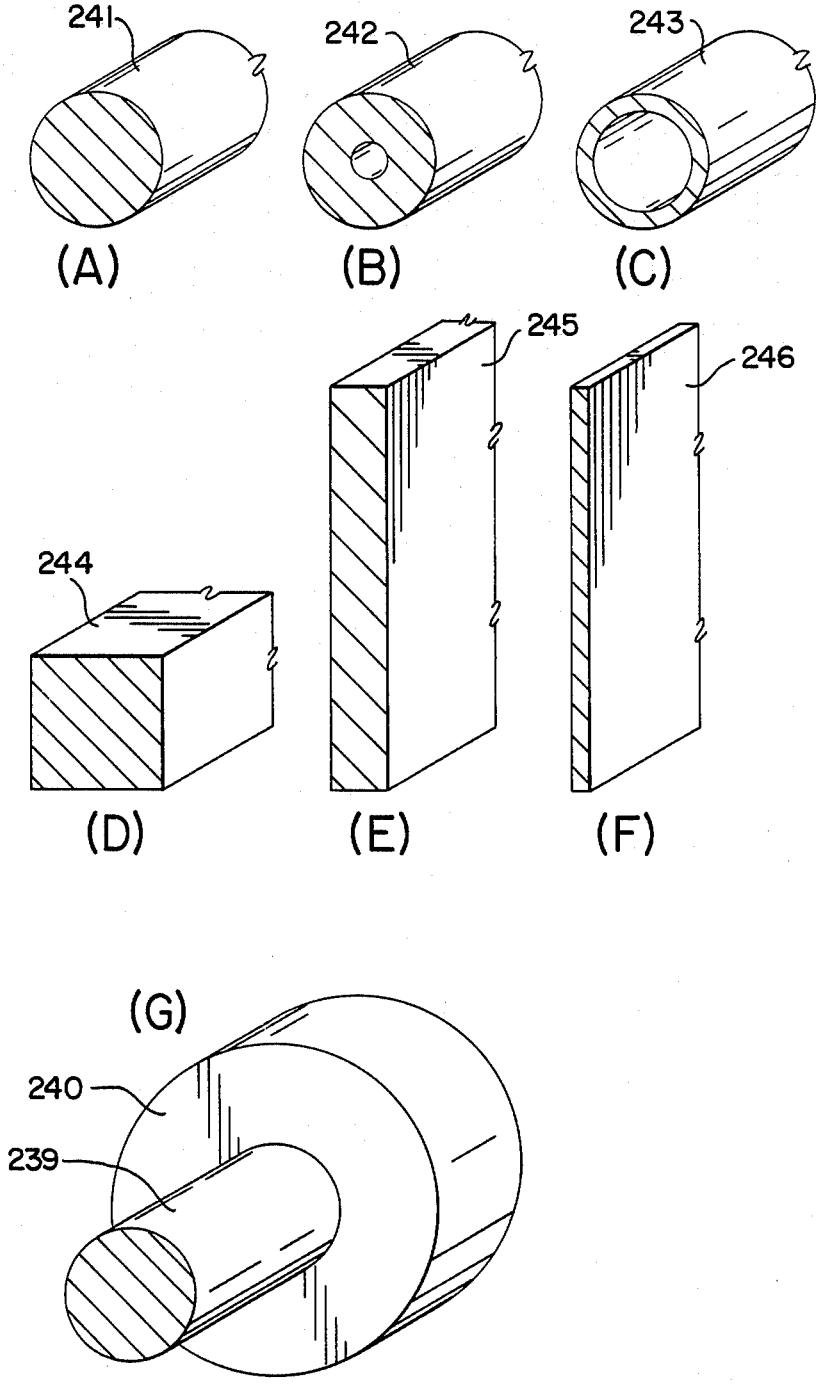
FIG. 14 is a series of perspective views, illustrating some of the semi-finished products which may be poured in accordance with this invention, namely, a round, a thick-walled hollow round, a thin-walled hollow round, a bloom, a slab, and a thin slab.

FIG. 14 shows the various products and shapes which may be manufactured in accordance with this invention. FIG. 14A shows a round 241 which may be made in the apparatus of FIGS. 1–7 or in that of FIGS. 8 and 9. A round is cylindrical, 4 to 20 inches (10 to 50 cm) in diameter and 10 to 30 feet (3 to 9 meters) long. FIG. 14B shows a thick-walled hollow round 242 which may be made in the apparatus of FIG. 10. FIG. 14C shows a thin-walled hollow round 243 which may be made in the same apparatus. FIG. 14D shows a billet or bloom which may be made in the apparatus of FIGS. 8–13. A billet is usually square, in the range of 2 1 by 2 inches (5 by 5 cm) up to 15 by 15 inches (38 by 38 cm), and at least 10 feet (3 meters) long. A bloom is usually square, in the range of 6 by 6 inches (15 by 15 cm) up to 12 by 12 inches (30 by 30 cm), and at least 10 feet (3 meters) long. Both billets and blooms can also be rectangular. FIG. 14E shows a slab 245 which may be made in the apparatus of FIGS. 8–13. A slab is a relatively flat, oblong rectangle with a width of from 24 to 80 inches (60 to 203 cm) or more, a length of from 10 to 30 feet (3 to 9 meters), and a thickness of from 2 to 10 inches (5 to 25 cm). A plate is like a slab except that it is thinner. FIG. 14F shows a plate 246 which may be made in the apparatus of FIGS. 8–13. FIG. 14G shows a headed round 239 which may be made in the apparatus of FIGS. 1–7. The head 240 is provided for in the pouring cup. In effect, a large pouring cup is provided with a lower portion which is made to form the head 240 with the remaining upper portion forming a feed head in the pouring cup which is cut off. The present method of manufacturing such products is to upset a round to form the head.

As will be apparent to those skilled in the art, other semi-finished products may be made in accordance with the process and apparatus of the present invention. It is believed that even irregular shapes such as "dogbones" can be made in accordance with this invention.

As noted, the pouring cups and the refractory barriers or covers for the plunger of FIGS. 1–7, and for the slab mold of FIGS. 11–13, are made from sand/binder mixtures such as are used in foundries to make cores which are slightly compressible and have good continued hot strength. One sodium silicate binder/carbon dioxide gas system is Carsil 700, sold by the Foseco Foundry Products Group in Cleveland, Ohio, U.S.A. Another system is a "no bake" system in which a sodium silicate binder is set up with a catalyst or chemical hardening agent, not carbon dioxide gas, such as is sold by the Thiem Division of Koppers Company in Milwaukee, Wis., U.S.A. under the name Thiem Chem Bond 31. Other foundry core making systems may also be used, preferably with inorganic binders such as fire clay, Western bentonite, Portland cement, or iron oxide. Resinous binders, such as phenolic resins, evolve a lot of gas and are less desirable. Refractory slurry systems may also be used. In systems which evolve water in the curing process, it is advisable to "torch" the refractory barrier or cover and/or pouring cup in order to drive off this water. This can be done with a soldering or welding torch with care so as not to harm the cured core sand.

The forces acting on the shim band are substantial and it must be well secured to the plunger. In place of the shim band 58 (FIG. 7), a suitable shim band may be made by welding a row of Nelson studs to the lower portion of the band, which will serve to hold it in place and avoid the necessity of slitting and bending it. The studs are welded at right angles to one flat side of the band in a row which extends the length of the band about a one-third width distance in from one edge. In order to assemble the shim band with the plunger piston or plunger block, the shim band is disposed vertically, with the studs extending horizontally from the lower portion of the shim band and resting on the piston or block. A metal retaining plate clamps and holds the studs onto the plunger piston or block and in this way holds the shim band.

The refractory barrier has several functions. In the first place, it insulates the plunger from the molten metal so that excessive heat is not drawn off from the bottom of the round or slab or the like which is being poured and a nugget of molten metal remains over the refractory barrier.

In the second place, it keeps the shim band pressed against the sidewalls of the mold to maintain a seal with the sidewalls of the mold against the passage of molten metal therethrough. At the same time, it is compressible so that when it expands from the heat of the molten metal, it compresses and will not bind up in the mold. My understanding is that $CO_2$ sand has a coefficient of expansion in the order of that of steel. The plunger moves down through the mold rapidly enough so that a mold section does not expand with heat until after the plunger has passed through that mold section. The refractory barrier, and particularly the top portion thereof, is in contact with molten metal and heats up and expands. The mold, as it maintains contact with the molten metal which has been poured into it, expands, but most of this expansion is believed to take place after the plunger has passed by.

It is contemplated that other forms of plungers which have a compressible refractory barrier or cover and a shim band or the equivalent and make a molten-metal-proof sliding seal with the sidewalls of the mold may be used in accordance with my invention, as will be apparent to those skilled in the art.

Preformed ceramic discs or blocks may be substituted for some of the sand, but should be embedded in sand so that there is a compressible buffer layer of sand between the shim band and the ceramic disc or block of at least about ½ inch (1.27 cm) to provide the necessary compensation for the thermal expansion forces as previously described. Unless compensated for, most ceramics have high coefficients of expansion and will expand against the shim band and bind or prevent the plunger from being lowered.

It has been found that the plunger must be pulled down to practice this invention. The friction forces between the plunger assembly and the inside walls of the mold and between the casting and the mold walls are substantially greater than the weight of the casting. As a result, a substantial pulling force must be applied to the plunger to cause it to descend. In one application, it has been found that the plunger is pulled with a force greater than twice the weight of the finished casting. It is believed that an additional downward force at least equal to the weight of the finished casting must be applied to the plunger to pull it down. Thus, the plunger does not support the casting and the plunger is not pushed downwardly solely by the weight of the molten metal in the casting.

As noted, a substantial lifting force should be applied to the bottom of the casting very quickly after the plunger has reached the limit of its descent or stroke so that the tensile forces which build up in a casting as it cools are greatly minimized or eliminated, and the casting preferably is put in compression. The purpose is to break any points of adhesion to the sidewalls of the mold, close any air gaps, and prevent hanger cracks. When the casting is lifted slightly out of the mold, along with the pouring cup and metal in the pouring cup, it is clearly in compression under its own weight plus the weight of the pouring cup. If the casting is not lifted out of the mold, the lifting force should be equivalent to, and preferably more than, the weight of the casting, feed head, and pouring cup.

Once the plunger stops its descent, the timing for the application of the upward lifting force may vary with the type of metal being cast, the type of product being cast, the weight and size of the product, and the tendency of the solidifying metal to adhere to the inside walls of the mold. The lifting force should be applied promptly, preferably within 30 seconds and at least within a minute of when the plunger bottoms out and should be applied while the reservoir is still feeding metal into the casting. Likewise, the amounts of the lifting force may vary with the same factors. For some products such as hollow rounds or very small slabs, however, the application of a substantial lifting force at the end of the pour may not be necessary. It is believed, however, that the application of a lifting force at the end of the pour universally improves the surface of the casting and the grain structure of the casting.

Bottom pouring ladles have been shown for filling the molds with molten metal because they provide the minimum exposure of the molten metal to the atmosphere gases. In some instances, lip pouring may prove to be preferable because a greater volume of metal can be poured in a shorter period of time.

The molds for making products in accordance with the process of this invention are preferably made of medium carbon steel. The molds may be made of other metals, however, such as titanium or copper. While copper molds may have to be water-cooled, they have greater thermal conductivity and greater coefficients of expansion, and may be found to be preferable for rounds.

Even though steel molds may be reused many times, they are not indestructible. They are nevertheless characterized herein as "permanent molds" to distinguish from molds which are destroyed with each pour or molds which last for only a relatively limited number of pours, such as ingot molds. The molds may be water-cooled, if desired, to speed up the production cycle.

For the round molds in particular, it is contemplated that the inside wall surface may be honed regularly in order to keep it smooth and clean. The inside surfaces of the slab molds may be cleaned by grinding or wire brushing from time to time.

For the most part, it is contemplated that this invention will be used for the manufacture of semi-finished ferrous products of low and medium carbon steels and of the various stainless steels. It may be used in the manufacture of products of other high melting point metals, such as nickel electrodes. More generically, it is believed that this invention has application in the casting of any product of uniform cross section of any metal with a melting point of over 1000° C. (1832° F.). This would include, for example, copper products. It should be understood, however, that a process which can cast ferrous metal products can probably cast copper products because copper is a lower melting, easier-to-handle metal. The reverse rule does not apply, that is, a process which can cast copper products probably cannot cast ferrous metal products.

As is inherent in the nature of this process and should be obvious from the foregoing description, the products must have a constant cross-sectional shape or configuration which corresponds to that of the mold and that of the plunger. The length of the product may be varied at will by the stroke of the plunger. If a short product is desired, the descent of the plunger can be halted above the bottom of the mold and the product length is thus determined by the limit of the descent or stroke of the plunger. It is contemplated that relatively long rounds, blooms and billets may be cast by my process, up to 40 feet (12 meters) or more in length.

The invention is not to be restricted to the details described above, which have been set forth by way of example. It will be understood that in accordance with the patent laws, variations and modifications of the inventions disclosed herein may be made without departing from the scope thereof.

What is claimed is:

1. A process of directly casting semi-finished products of a high-melting-point metal with constant cross sections in a permanent metal mold which has smooth sidewalls which form a casting cavity with a cross section corresponding to that of the products to be cast, comprising the steps of:

(a) attaching to a plunger a thin, resilient metal band which extends above the top of the plunger;

(b) disposing said plunger in the top portion of the casting cavity and placing the resilient metal band against the sidewalls of the mold so that the ends overlap;

(c) forming on top of the plunger inside of the metal band a solid refractory barrier which holds the metal band against the sidewalls of the mold, which withstands the impact of the high-melting-point molten metal being poured upon it, which insulates the molten metal from the plunger, and which compresses to compensate for the forces generated by thermal expansion;

(d) pouring molten metal of a high-melting-point into a reservoir disposed above the casting cavity and as the reservoir begins to fill, causing the plunger to descend relative to the mold toward the bottom of the cavity at a controlled rate of from ½ to 4 inches per second while keeping the reservoir supplied with molten metal, thereby causing molten metal to enter and fill the space being created above the plunger as it descends;

(e) promptly after the plunger has completed its descent, and after the semi-finished metal product casting thus formed has cooled enough to have vertical strength, raising the plunger relative to the mold to lift the casting enough to break any adhesions with the sidewalls of the mold and prevent hanger cracks while maintaining the reservoir in communication with the casting so as to feed it as the metal solidifies and shrinks;

(f) allowing the casting to continue to cool and further solidify enough to be handled; and (g) stripping the cast product from the mold without damaging the plunger so that the mold and plunger can be used again.

2. The process of claim 1, in which the semifinished products are rounds.

3. The process of claim 1, in which the semifinished products are slabs.

4. The process of claim 1, in which the high-melting-point metal is steel.

5. The process of claim 1, in which the high-melting-point metal is stainless steel.

6. The process of claim 1, in which the plunger is elevated enough to lift the casting and reservoir at least slightly out of the mold.

7. The process of claim 1, in which the plunger is pulled downwardly.

8. The process of claim 1, in which the mold is a steel mold.

9. The process of claim 1, in which the mold is a copper mold.

10. The process of claim 1, in which the refractory barrier is formed of silica sand with a suitable core binder which is rammed into the space above the plunger and then cured.

11. The process of claim 1, in which the metal band is steel with a thickness of less than 0.035 inch.

12. An apparatus for directly casting semifinished products of a high-melting-point metal of constant cross section which comprises:

(a) a metal mold with smooth vertical sidewalls which define a casting cavity having a constant cross section which corresponds to the cross section of the products to be cast;

(b) a plunger adapted to be lowered and raised in the casting cavity, the plunger having a cross section which is about the same as but slightly smaller than that of the casting cavity;

(c) a resilient metal band attached to the plunger with overlapped ends and with upstanding portions which extend substantially above the top of the plunger and are disposed against the vertical sidewalls of the mold to make a sliding seal with the sidewalls;

(d) a solid, slightly compressible, insulating refractory barrier on top of said plunger inside of said metal band which holds said band against the sidewalls of the mold but which, together with the shim band, has enough give to accommodate the thermal forces generated by expansion of said barrier and shim band so as to prevent binding up thereof within the mold;

(e) a reservoir for molten ferrous metal on the top of the mold over the casting cavity for supplying molten metal to the cavity over the plunger; and (f) means for lowering and raising the plunger.

13. The apparatus of claim 12, in which silica sand is rammed into the space inside the metal band and is then cured in place to act as the refractory barrier.

14. The apparatus of claim 12, in which the metal band is steel shim stock with a thickness of between 0.015 and 0.035 inch.

15. The apparatus of claim 12, in which the metal mold is steel.

16. The apparatus of claim 12, in which the metal mold is copper.

17. An apparatus for casting rounds directly from molten, high-melting-point metal which comprises:

(a) a tubular steel cylinder mounted vertically on a supporting platen with a smooth inside surface defining the casting cavity, the weight of the cylinder being at least one and one-half times the weight of the round to be cast;

(b) a cylindrical plunger adapted to be lowered and raised in the casting cavity;

(c) a thin, resilient steel band with upstanding portions placed against the inside surface of the casting cavity above the top of the plunger and which is attached to the plunger, the upstanding portions extending at least 1½ inches above the top of the plunger;

(d) a layer of rammed-up, cured-in-place silica sand on top of the plunger inside the steel band;

(e) means for lowering and raising the plunger; and (f) a reservoir for molten metal on top of the tubular steel cylinder.

18. An apparatus for casting slabs directly from molten ferrous metal which comprises:

(a) strongback steel side blocks mounted on a base;

(b) strongback steel end blocks mounted on the base between said side blocks to define a slab casting cavity;

(c) means to clamp the side blocks against the end blocks;

(d) a plunger with substantially the same cross-sectional shape as that of the slab casting cavity adapted to be lowered and raised in said cavity;

(e) a thin, flexible steel band with upstanding portions placed against the inside surface of the casting cavity above the top of the plunger and which is attached to the plunger, the upstanding portions extending at least 1½ inches above the top of the plunger;

(f) a layer of rammed-up, cured-in-place silica sand on top of the plunger inside the steel band;

(g) means for lowering and raising the plunger; and (h) a reservoir for molten metal on top of the tubular steel cylinder.

* * * * *